US005121615A

United States Patent [19]

Yu

[11] Patent Number: 5,121,615

[45] Date of Patent: Jun. 16, 1992

[54] DRYING DEVICE INCORPORATED WITH A WASHING MACHINE

[75] Inventor: Chih-Hua Yu, Taipei, Taiwan

[73] Assignee: Taiwan Electric Heating Equipment Co., Ltd., Taipei, Taiwan

[21] Appl. No.: 712,140

[22] Filed: Jun. 5, 1991

[51] Int. Cl.[5] ..... D06F 25/00; D06F 58/04

[52] U.S. Cl. ..... 68/20; 34/133 P

[58] Field of Search ..... 68/19.2, 20; 34/133 J, 34/133 L, 133 N, 133 P, 139

[56] References Cited

U.S. PATENT DOCUMENTS 2,126,426 8/1938 Traube ..... 68/20 X 3,247,690 4/1966 Kahn ..... 68/19.2 X 3,902,337 9/1975 Files ..... 68/19.2

FOREIGN PATENT DOCUMENTS 0152167 8/1985 European Pat. Off. ..... 34/133 P

*Primary Examiner*—Philip R. Coe

*Attorney, Agent, or Firm*—Christie, Parker & Hale

[57] ABSTRACT

A drying device of a washing machine includes a housing with a perforated drum disposed in the housing. A stationary drum is provided around the perforated drum forming a clearance between them. A plurality of radially extending and circumferentially spaced ribs project outward from the wall of the perforated drum to a position adjacent to the stationary drum.

1 Claim, 4 Drawing Sheets

DRYING DEVICE INCORPORATED WITH A WASHING MACHINE

BACKGROUND OF THE INVENTION

1. Field of Invention

The invention relates to a washing machine including a cleaning device, a draining device and a drying device. more particularly to the drying device of the washing machine.

2. Description of the Related Art

It has been quite a long time since washing machines became one of our daily essentials. When we say a washing machine, every one understands that it also includes a draining device. Some washing machines further include a drying device so that washing, draining and drying of clothes can be accomplished in one time. thereby saving labour and our precious time.

FIG. 1 shows a drying device of the latest washing machines. As shown in illustration, the drying device includes a housing (A), a rotatable drum (B) provided in said housing (A), a driving means (D) for rotating said rotatable drum (B) and a hot air producing unit (C). During operation, not all the hot air always enters said rotatable drum because there is no means provided in the housing make sure it does. Some portion of the hot air escapes from a clearance between the housing (A) and the rotatable drum (B) into the environment through the outlet in the housing. Thus, such a drying device wastes energy.

SUMMARY OF THE INVENTION

Therefore, the main object of the present invention is to provide a drying device to be used in conjunction with a washing machine, which drying device has a means to prevent hot air from escaping from the housing of said drying device without entering the rotatable drum so as to dry clothes in said drying device more quickly than the above-mentioned drying device.

Accordingly, a drying device of the present invention includes a housing, a rotatable drum disposed in the housing and having a perforated wall and one closed perforated end, a motor also disposed in the housing for rotating the rotatable drum and a hot air producing unit for supplying hot air into the rotatable drum. The drying device further includes a stationary drum provided around the rotatable drum forming a clearance between the stationary drum and the perforated wall. A plurality of circumferentially spaced ribs extend from the outer surface of the perforated wall towards the stationary drum, dividing the clearance into several isolated chambers. The hot air producing unit has an hot air output in communication with the chamber which is adjacent to the edge of the perforated wall.

BRIEF DESCRIPTION OF THE DRAWINGS

Other features and advantages of the present invention will become more apparent in the following detailed description, including drawings, all of which show a non-limiting form of the invention, and of which.

DETAILED DESCRIPTION OF THE PREFERRED EMBODIMENT

Figure 1:
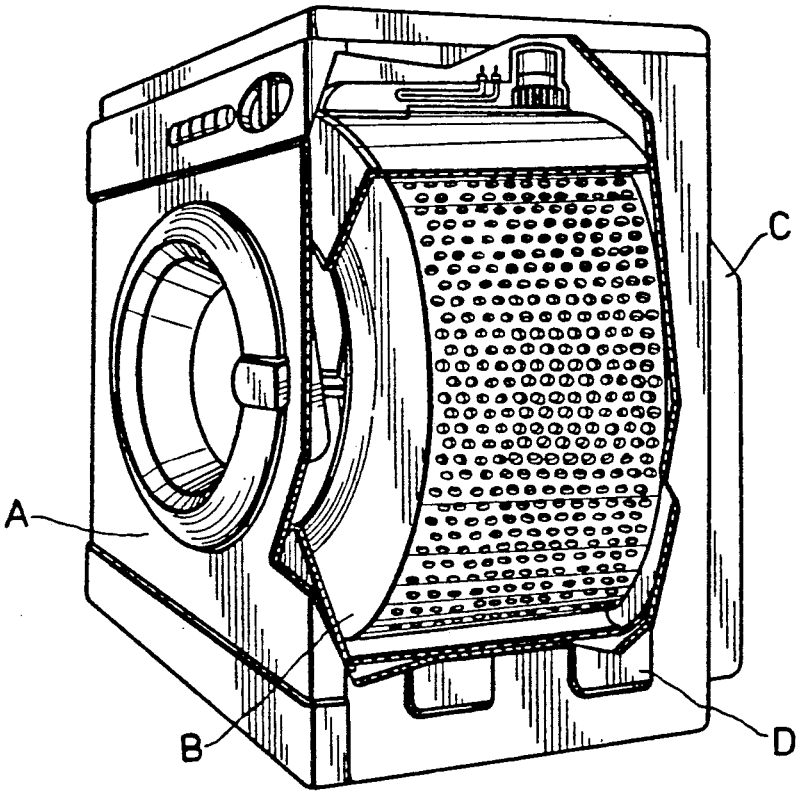
FIG. 1 (PRIOR ART)
FIG. 1 is a partially exploded view of a drying device of a washing machine, according to prior art.
Figure 2:
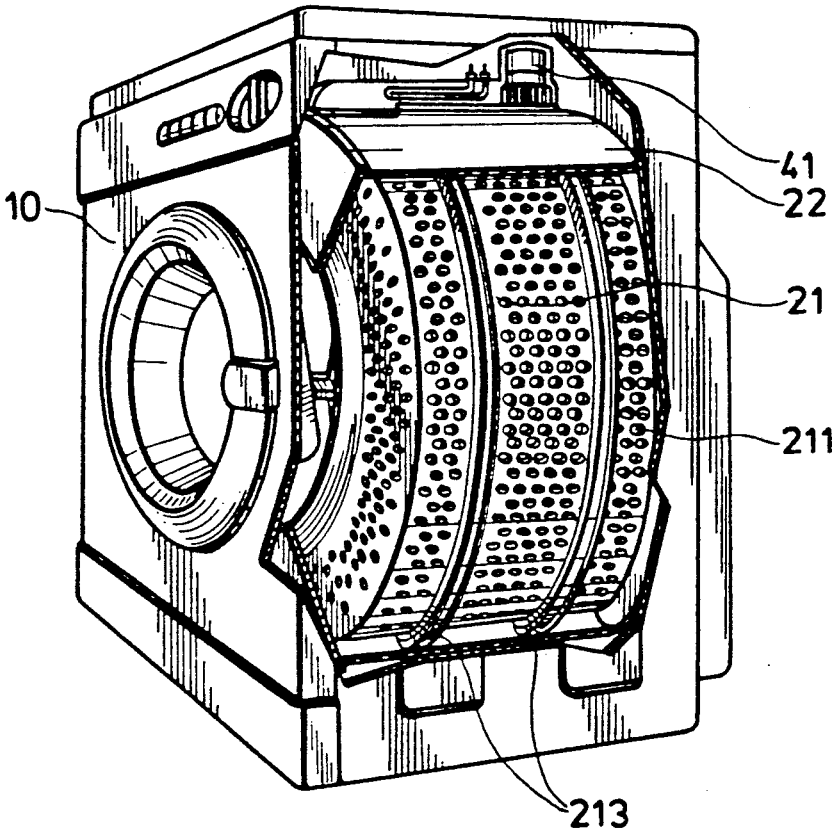
FIG. 2 is a partially exploded view of a drying device of a washing machine of the present invention.
Figure 3:
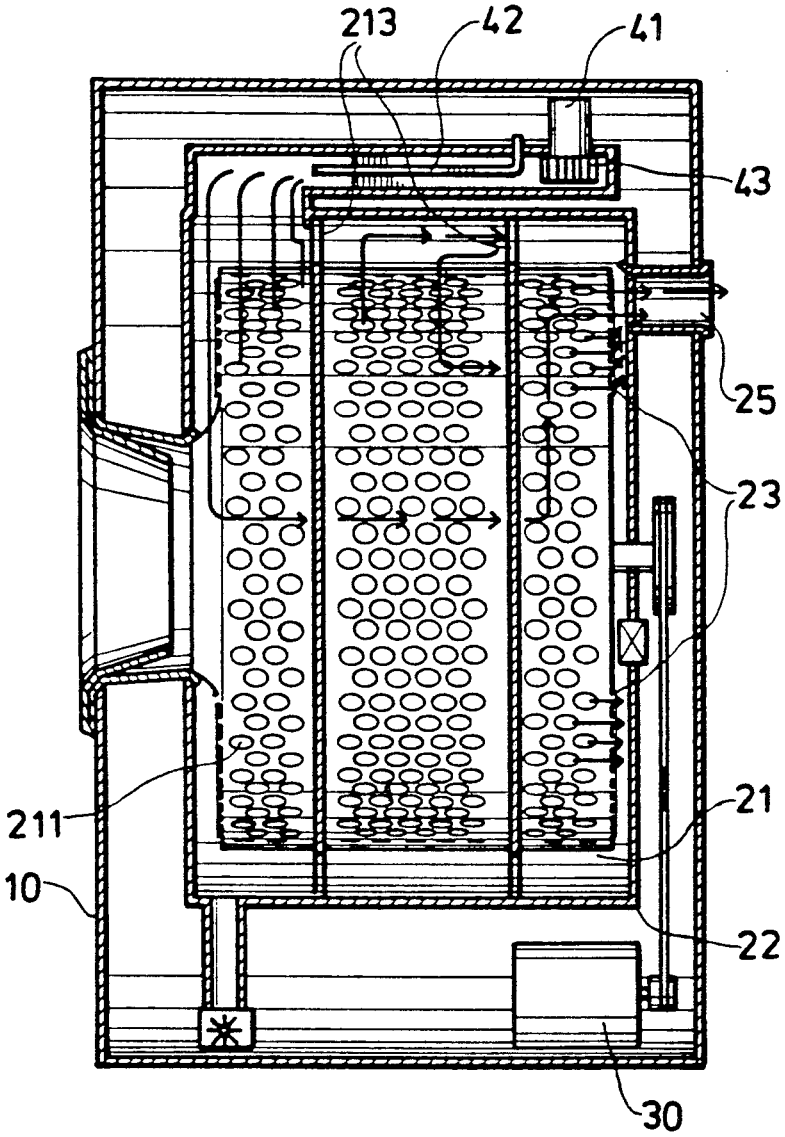
FIG. 3 is a cross sectional view of a drying device of a washing machine of the present invention.

Referring to FIGS. 2 and 3, a drying device of the present invention is shown to comprise a housing (10), a rotatable drum (21) disposed in the housing, a motor (30) also disposed in the housing (10) for rotating the rotatable drum (21), and a hot air producing unit (41) for blowing hot air into the rotatable (21) drum thereby to dry the clothes in the rotatable drum. These parts are generally similar to prior art ones.

The most outstanding differences in the present invention are that a stationary drum (22) is provided around the rotatable drum (21), forming a clearance between the rotatable drum (21) and the stationary drum (22). The rotatable drum (21) in this embodiment has a plurality of holes (211) formed in the wall of the rotatable drum (21), a plurality of circumferential, spaced ribs (213) extending from the outer surface of the perforated wall of the rotatable drum (21) toward a position adjacent to the inner surface of the wall of the stationary drum (22), dividing the clearance into a plurality of isolated chambers, as shown in FIG. 3.

The housing (10) and the rotatable drum (21) in this invention each also have air outlets (25,23) formed at the back of the same. The hot air producing unit (41) including a blower (43) and a heating element (42), is provided at the top portion of the housing (10). A passage (24) is formed at the top portion of the housing (10) through which hot air passes into one of the isolated chambers adjacent to the opening of the rotatable drum (21), in a direction shown by arrows in FIG. 3. The hot air enters into the rotatable drum (21) directly since the ribs (213) prevent the hot air from escaping through the clearance between the stationary drum (22) and the rotatable drum (21). This is one of the most distinguished feature of the present invention. Thus the drying device of the present invention can dry the clothes more quickly when compared with that of prior art ones.

Figure 4:
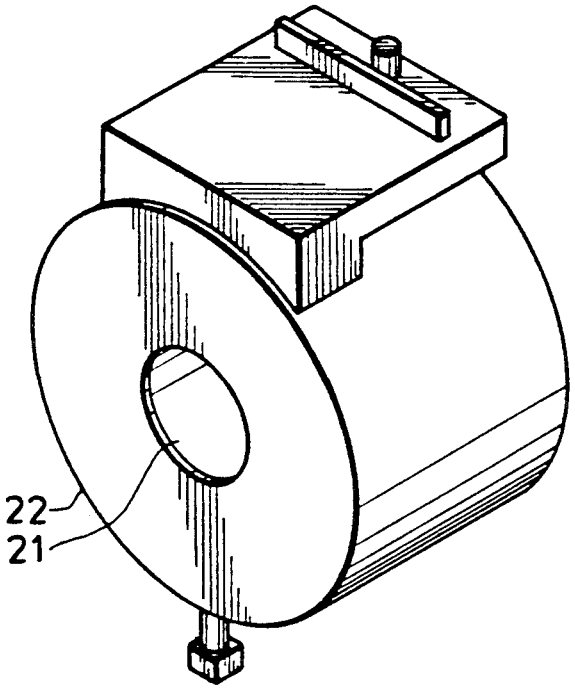
FIG. 4 is detailed view of a rotatable drum and the stationary drum of a drying device of a washing machine of the present invention.

FIG. 4 shows a perspective view of the rotatable drum (21) and the stationary drum (22) without the housing (10).

With the invention thus explained, it is obvious to those skilled in the art that various modifications and variations can be made without departing from the spirit and scope of the present invention. It is therefore intended that this invention be limited as only in the appended claims.

I claim:

1. A washing machine having a cleaning device, a draining device and a drying device, said drying device including a housing, a rotatable drum disposed in said housing, said rotatable drum having a perforated closed end and an open end opposite to said perforated closed end, a driving means disposed in said housing for rotating said rotatable drum, and a hot air producing unit provided in said housing;

characterized in that said rotatable drum having a perforated wall connecting said perforated closed end to said open end;

a stationary drum provided around said perforated wall of said rotatable drum, forming a clearance between said perforated wall of said rotatable drum and said stationary drum;

a plurality of radially extending and circumferentially spaced ribs projecting outward from said perforated wall of said rotatable drum toward a position adjacent to said stationary drum, said ribs dividing said clearance into a plurality of isolated chambers; and a hot air output of said hot air producing unit communicated with a first one of said isolated chambers adjacent to said open end of said rotatable drum.

* * * * *